US007895698B2

(12) United States Patent
Mink

(10) Patent No.: US 7,895,698 B2
(45) Date of Patent: Mar. 1, 2011

(54) APPLICATOR BRUSH

(75) Inventor: Jeffrey Mink, Glen Head, NY (US)

(73) Assignee: FM Brush Co., Inc., Glendale, NY (US)

( * ) Notice: Subject to any disclaimer, the term of this patent is extended or adjusted under 35 U.S.C. 154(b) by 1107 days.

(21) Appl. No.: 11/640,735

(22) Filed: Dec. 18, 2006

(65) Prior Publication Data

US 2008/0141479 A1 Jun. 19, 2008

(51) Int. Cl.
*A46B 15/00* (2006.01)

(52) U.S. Cl. ..... 15/207.2; 15/159.1; 15/DIG. 5; 15/160

(58) Field of Classification Search ..... 15/207.2, 15/159.1, 160, 167.3, 168, DIG. 5; D4/132, D4/135
See application file for complete search history.

(56) References Cited

U.S. PATENT DOCUMENTS 4,483,036 A * 11/1984 Sayklay ..... 15/160
4,998,315 A * 3/1991 Pessis ..... 15/160
5,507,063 A * 4/1996 Hirsch ..... 15/160
6,108,847 A * 8/2000 Cueman et al. ..... 15/104.94
6,367,114 B1 * 4/2002 Babkowski ..... 15/207.2
2004/0003478 A1 1/2004 Mink

* cited by examiner

*Primary Examiner*—Shay L Karls
(74) *Attorney, Agent, or Firm*—Kay & Associates, P.C.

(57) ABSTRACT

An applicator brush for applying a material to a surface is provided having a brush head of a width X arranged along a central axis. The brush head includes a first set of bristles having proximal base ends attached to a ferrule and distal ends defining a first edge situated in a substantially straight first plane perpendicular to the central axis. The first set of bristles have a first width Y, wherein Y<X. A second set of bristles is provided having proximal ends attached to the ferrule and distal ends defining a second edge situated in a second plane having a second width (X-Y). A length of each bristle in the first and second sets is defined as a distance between its proximal attachment point and its distal end.

12 Claims, 4 Drawing Sheets

APPLICATOR BRUSH

TECHNICAL FIELD OF THE INVENTION

The present invention generally relates to brushes and, more particularly, to applicator brushes for improved application of materials for, e.g., cosmetic and artistic purposes.

BACKGROUND OF THE INVENTION

Brushes made with natural and/or synthetic bristles are used for a variety of activities involving the application of various products and substances. Specially designed brushes may be employed where specific control is needed during application of e.g., cosmetic substances and artistic materials used in creating works of art.

There are numerous cosmetic and artistic substances and materials provided in an array of forms designed for application to various surfaces, such as the skin, as well as a variety of permeable and non-permeable surfaces such as paper, canvas, wood, ceramics, plastics, etc. Regardless of the form of a cosmetic/art material, e.g., whether in liquid, semi-liquid or solid forms, a primary object involves achieving application of the desired product(s) in a specific amount, shape, at a particular location, etc. In particular, application of the product in a specific manner becomes critical when a certain effect is desired, whether on a human face, in a painting, etc.

Brushes having specialized forms for facilitating certain applicator effects have been introduced. For example, a brush having pillared bristles is disclosed in U.S. Published Application 2004/0003478 that is designed for use with a stencil mask as a fabric paintbrush or as an artist's paintbrush. Brushes having angular tips have also been introduced, e.g., to facilitate various artistic and coverage effects and designs.

However, such brushes are generally limited in their applicator effects, especially, e.g., with respect to the application of multiple product types. For example, a user must typically use multiple brushes if different types (e.g., colors, consistencies, formulas) of product are desired to be effectively and cleanly applied to a surface. If shading/blending is desired, the separate applications from the multiple brushes must thereafter be blended in yet an additional step, sometimes using yet another brush. Even a slight pause in time however, can negatively affect smooth blending depending, e.g., on the nature (volatility, consistency, etc.) of the materials used. Undesirable streaking, or defined striping/spotting can occur if there is any delay in the time between deposition of materials on a surface and blending of same.

Accordingly, a brush, in particular, an applicator brush for providing improved precision, versatility, ease of achieving desired effects, smoother blending during use and simultaneous application of multiple products, is highly desirable.

SUMMARY OF THE INVENTION

The present invention provides an applicator brush instrument having a specialized bristle head comprised of a tuft of bristles arranged in a substantially laterally flattened formation having a width X and secured at a proximal end to a ferrule or bushing. The bristle head comprises at least two sets of bristles, each configured in a separate and distinct arrangement from each other on a single bristle head, advantageously enabling, e.g., separate take-up of different substances (pigments, dyes, powders, etc.) whether in solid, liquid or semi-solid form, and simultaneous and controlled application of the multiple substances in, e.g., a single stroke. During use, the brush head according to one aspect of the present principles can maintain physical separation of multiple substances, yet allows their simultaneous distribution, application and/or blending if desired.

The bristles of the multiple sets are provided comprised of particular lengths, proportions and edge configurations. Accordingly, the creation of unique and complex patterns, textures and effects during application of various substances using a variety of techniques is facilitated. A brush according to the present invention may be utilized with advantageous effect in a variety of applications, such as cosmetic applications, art and crafts, painting, etc., and may be used to apply a variety of substances, preferably flowable, in solid, liquid or semi-solid form.

According to one aspect, a brush head having a width X and a central axis is provided, the brush head comprising a ferrule and a first set of bristles having proximal base ends attached to the ferrule and distal ends defining a first edge situated in a substantially straight first plane perpendicular to the central axis, the first set of bristles having a first width Y, wherein $Y<X$. A second set of bristles is provided having proximal ends attached to the ferrule and distal ends defining a second edge situated in a second plane having a second width (X-Y), wherein a length of each bristle in the first and second sets comprises a distance between its proximal attachment point and its distal end.

According to another aspect, a brush is provided comprising an elongate handle extending along a central axis, and a ferrule attached to the handle at a first end. A brush head is provided having a width X. The brush head comprises a first set of bristles having proximal base ends attached to a second end of the ferrule and distal ends defining a first edge situated in a substantially straight first plane perpendicular to the central axis, the first set of bristles having a first width Y, wherein $Y<X$. The brush head further comprises a second set of bristles is provided having proximal ends attached to the second end of the ferrule and distal ends defining a second edge situated in a second plane having a second width (X-Y), wherein a length of each bristle in the first and second sets comprises a distance between its proximal attachment point and its distal end.

These and other aspects, features and advantages of the present invention will be described or become apparent from the following detailed description of preferred embodiments.

DETAILED DESCRIPTION OF PREFERRED EMBODIMENTS

Figure 7:
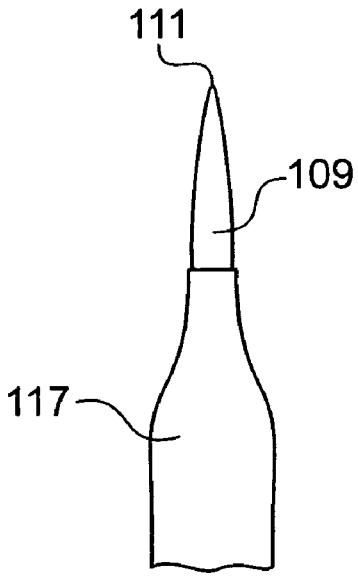
FIG. 7 is a right side view of the brush head of FIG. 1 according to an aspect of the present invention.
Figure 8:
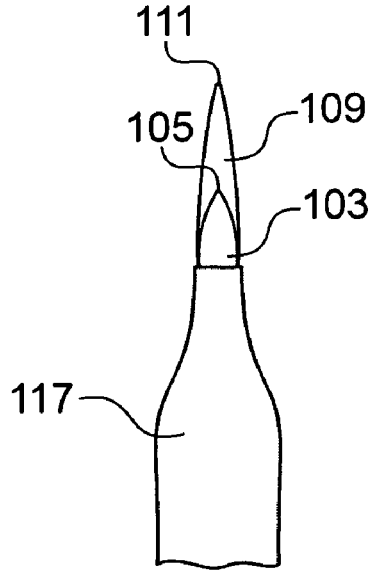
FIG. 8 is a left side view of the brush head of FIG. 1 according to an aspect of the present invention.
Figure 9:
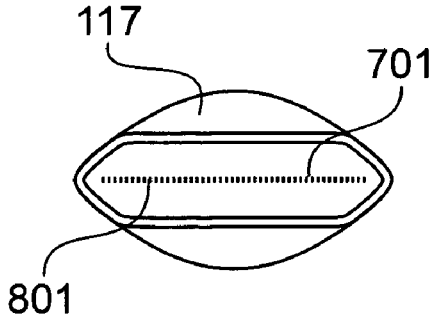
FIG. 9 is a top view of the brush head of FIG. 1 according to an aspect of the present invention.

Referring now to the Figures, FIGS. 1-6 depict front views of brush heads according to various exemplary embodiments of the present invention. FIGS. 7, 8 and 9 depict right side, left side and top views, respectively, of the brush head of FIG. 1. A brush head according to one aspect of the present invention is comprised of or 'split' into at least two 'sets' of bristles having at least two distinct edges, both sets being generally flattened in shape when secured to a ferrule. In one embodiment, the bristle sets are comprised of different lengths and may include edges situated on various planes/angles/degrees of curvature. Such configurations advantageously enable separate and/or simultaneous contact of either/both bristle set edges onto a surface during use. Improved control, precision and blending is thus enabled, as well as application of multiple materials, whether of solid, semi-solid or liquid form, either separately or concurrently.

A brush head according to an aspect of the present invention may be provided configured to be attached or already attached, e.g., to any type of handle in any length, width, or configuration (e.g., preferably of an elongate shape) to facilitate manual manipulation of the brush head. The handles shown in FIGS. 1-8 are for illustrative purposes only and have been partially cutaway in the views. Further, the bristles may be formed to their respective shapes/configurations/edges as discussed herewith subsequent to their attachment to a ferrule, e.g., the bristles may be trimmed to the desired configurations/lengths after the bristles are attached to the ferrule, and/or be provided pre-trimmed to their desired configurations/lengths prior to their attachment to the ferrule.

Figure 1:
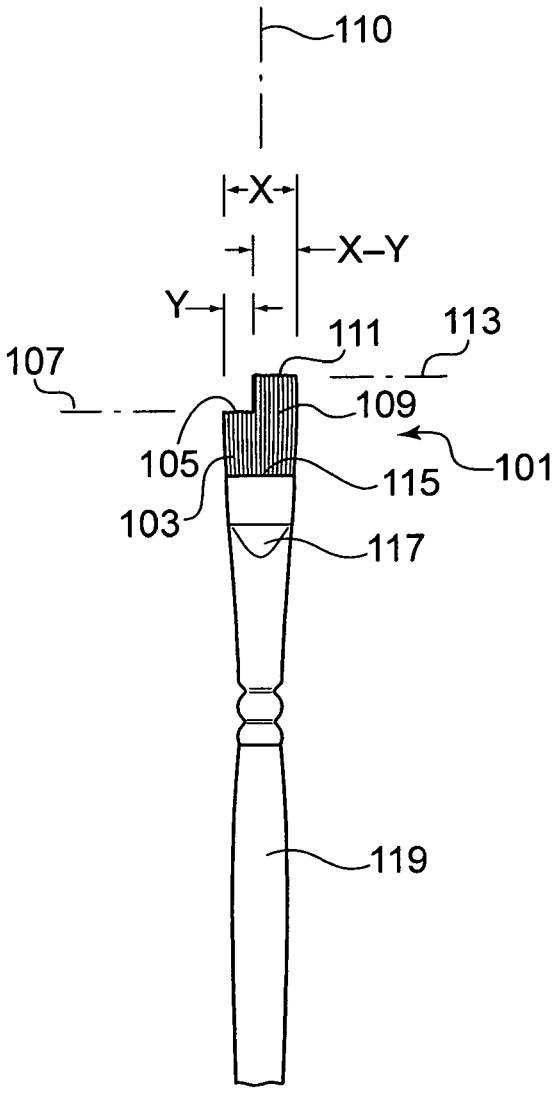
FIG. 1 is a front view of a brush head according to an embodiment of the present invention.

For example, in FIG. 1, a brush head 101 having a total width X and a central axis 110 is shown comprising a first set of bristles 103 having distal ends defining a first edge 105 situated in a substantially straight first plane 107 having a first width Y, wherein Y<X. The brush head 101 includes a second set of bristles 109 having distal ends defining a second edge 111 situated in a second plane 113 having a second width (X-Y). Preferably, a width Y (e.g., width of the shorter bristle set) is at least about 35% of the total width X of a bristle head.

In one exemplary embodiment, the second plane 113 comprises, e.g., a substantially straight plane, being substantially parallel to plane 107. Each plane 107 and 113 is preferably substantially perpendicular to the central axis 110, which runs longitudinally along the brush head 101 and extends through handle 119.

Each bristle of the first 103 and second set 109 of bristles includes a proximal base end 115 attached to a ferrule 117. A length of each bristle in the bristle head is defined as a distance between its proximal attachment point 115 and its distal end 105 or 111. In the embodiment shown in FIG. 1, a length of each bristle in the second set of bristles 109 preferably exceeds the length of the first set of bristles 103.

Various proportional differences between the lengths of the first and second sets of bristles on a brush head may be contemplated; that is, the length of one set of bristles (e.g., the second set 109) may be provided at any length which is greater than the length of the other set of bristles (e.g., the first set 103). Brush heads having first and second bristle sets configured in any variety of lengths may be provided, e.g., for different applications.

Figure 2:
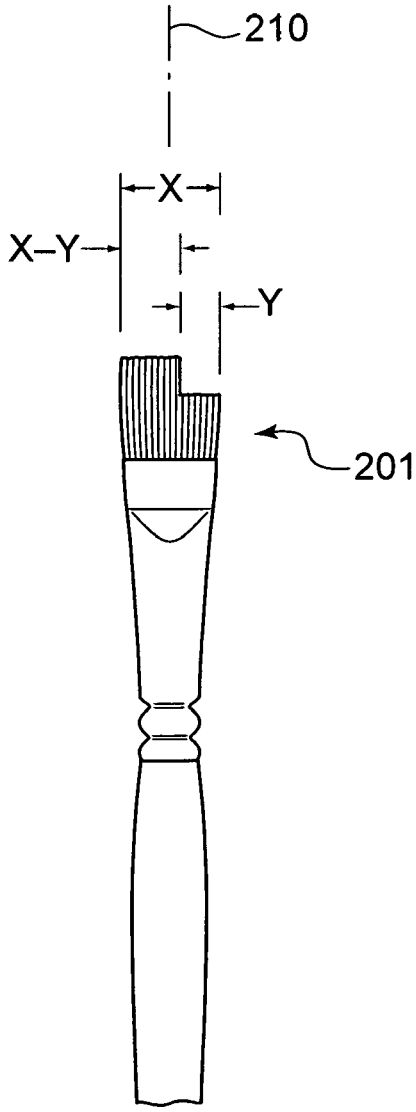
FIG. 2 is a front view of a brush head according to another embodiment of the present invention.

Furthermore, brush heads having various widths X may be provided. For example, FIG. 2 depicts an exemplary brush head 201 with central axis 210 similar in configuration to the brush head 101 of FIG. 1, but having a greater total width X, and accordingly, greater bristle set widths (X-Y) and Y.

In one exemplary embodiment, the second set of bristles (e.g., 109) is provided at a length which is preferably at least about 50% greater than the length of the first set of bristles (e.g., 103). For example, if a first set of bristles 103 is provided at a length of about X mm, a length of a second set of bristles 109 preferably comprises at least about X+0.50(X) mm. However, alternate lengths of the first and second bristle sets may be contemplated.

Figure 3:
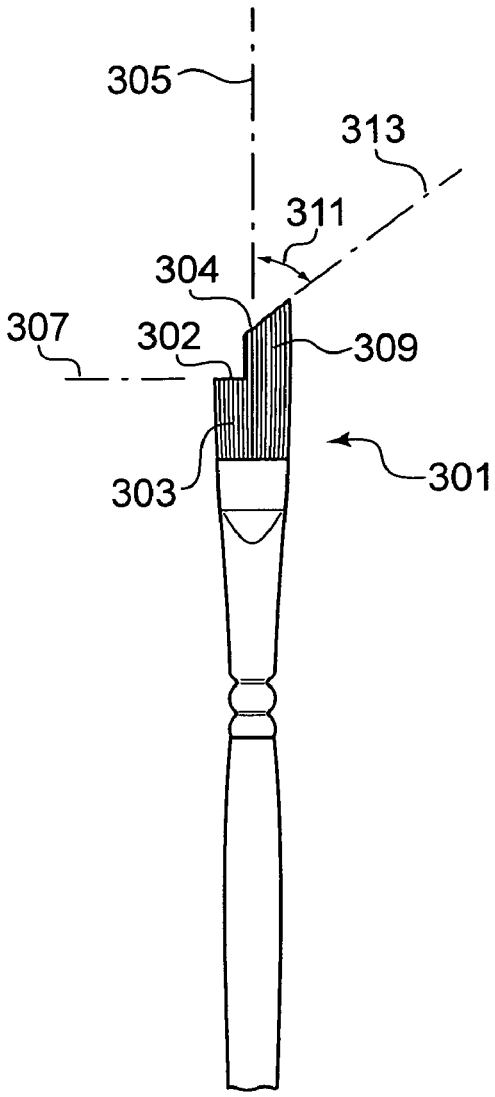
FIG. 3 is a front view of a brush head according to another embodiment of the present invention.
Figure 4:
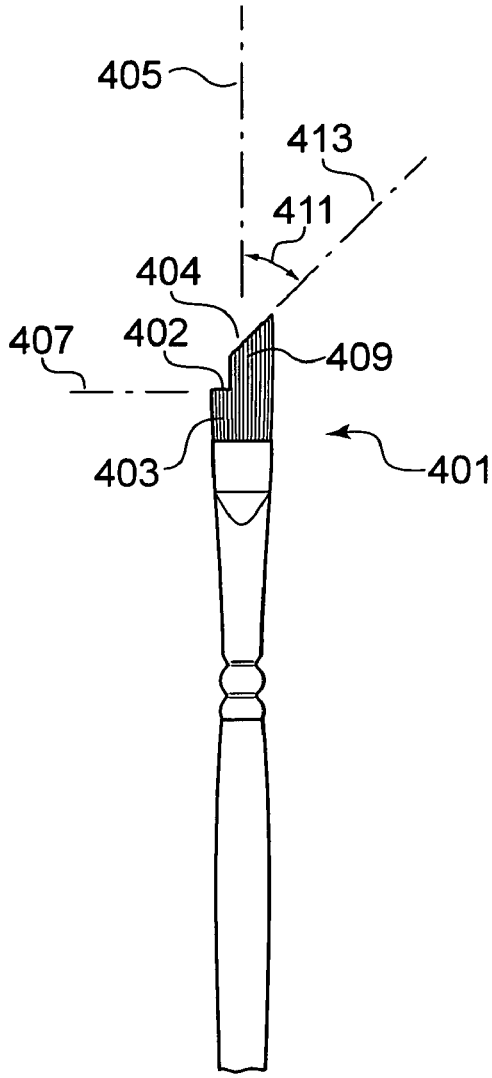
FIG. 4 is a front view of a brush head according to another embodiment of the present invention.

FIGS. 3 and 4 depict examples of brush heads oriented along central axes 305, 405 according to alternate embodiments of the present invention. Each head 301, 401 comprises a first set 303, 403 of bristles having distal ends defining first edges 302, 402 situated in substantially straight planes 307, 407. Each first edge 302, 402 is substantially perpendicular to their respective central axes 305, 405.

A second set 309, 409 of bristles is provided having distal ends defining second edges 304, 404 situated in substantially continuous sloped planes 313, 413, e.g., so as to form a sloped profile. Preferably, each sloped edge 304, 404 lies in a plane which intersects the central axis 305, 405 of the brush head 309, 409 at a non-orthogonal angle.

FIG. 3 shows an angle 311 of approximately 50 degrees and FIG. 4 shows an angle 411 of approximately 45 degrees as demonstrative of exemplary 'non-orthogonal angles' of intersection of sloped planes 313, 413 with regards to their respective central axes 305, 405; however, it is noted that the planes 313, 413 may intersect at any non-perpendicular angle to the central axis of a brush head on which they are provided. That is, any range of non-orthogonal angles may be contemplated to provide, e.g., varying levels of angulation of the second set of bristles of the brush head.

Figure 5:
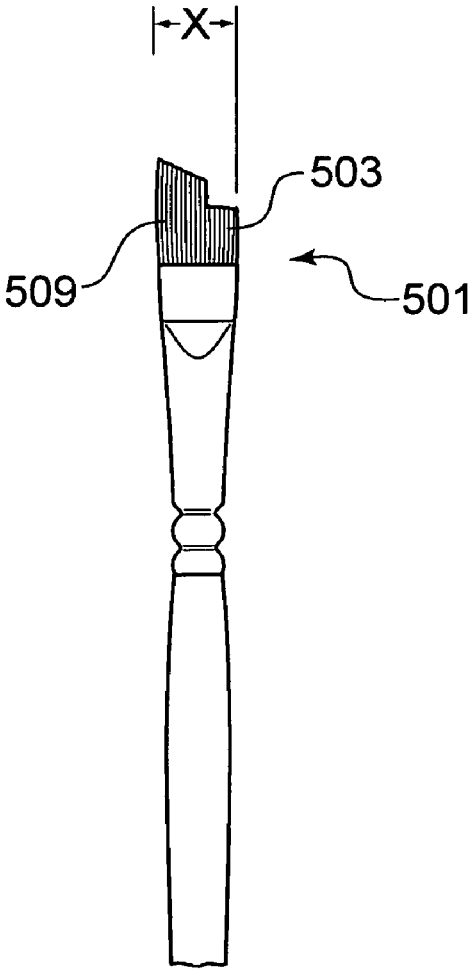
FIG. 5 is a front view of a brush head according to another embodiment of the present invention.

Preferably, the slope of the second set of bristles 309, 409 is oriented such that a lower end of each slope is positioned nearest/adjacent to the first set of bristles 303, 403, as shown, e.g., in FIGS. 3-5. FIG. 5 shows a brush head 501 according to another embodiment, having a greater width X than the brush heads 301, 401. Brush head 501 includes a first bristle set 503 and a second angulated bristle set 509.

A length of the shortest bristle(s) of the angulated/sloped edge preferably is at least 40% greater than a length of the bristles of the first set (e.g., 303, 403, 503). To illustrate, exemplary lengths of the bristles of the first set/shortest bristles of the second set in the angulated embodiments as depicted in FIGS. 3-5 may comprise, e.g., about 7 mm/11 mm, about 8 mm/13 mm, and about 11 mm/18 mm, respectively. Alternate bristle length combinations may be contemplated.

Figure 6:
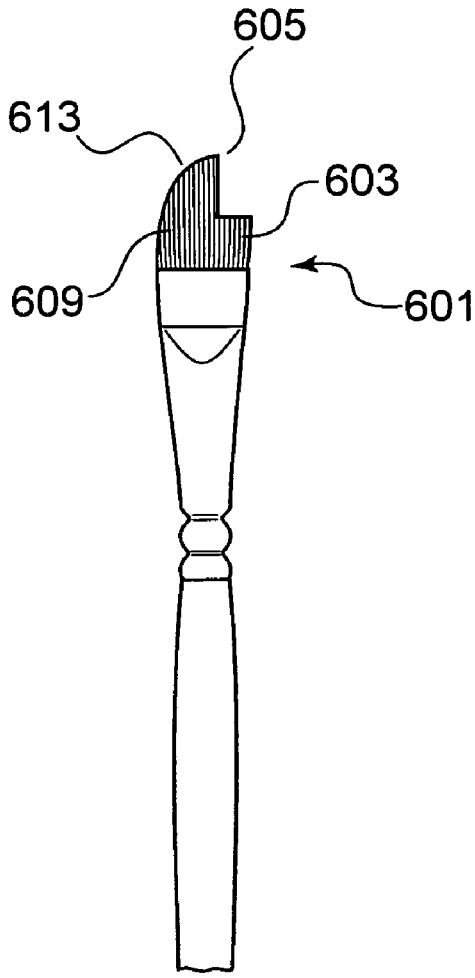
FIG. 6 is a front view of a brush head according to another embodiment of the present invention.

FIG. 6 depicts a brush head according to an alternate embodiment of the present invention. A brush head 601 includes a first set of bristles 603 having distal ends terminating on a substantially straight plane. A second set of bristles 609 is provided comprised of a plurality of bristles having distal ends terminating along a substantially curved or semi-circular plane 613. The bristles of the second set may be trimmed/shaped to any degree of curvature as desired. Preferably, in a curved bristle set embodiment, the curve is oriented so that the highest point of the curve 605 is adjacent to the first set of bristles 603 (e.g., as shown in FIG. 6).

According to an aspect of the present invention, at least the distal ends of the first and second sets of bristles in a brush head are preferably trimmed/shaped/arranged/tapered to form a 'chiseled' edge, e.g., as shown in FIGS. 7-8. FIG. 7 is a right side view of the brush of FIG. 1, showing an edge 701 of the second bristle set 109. FIG. 8 is a left side view of the brush head 101, showing an edge 801 of the first bristle set 103. As shown e.g., in the side views of FIGS. 7 and 8, the bristles are preferably tapered such that a width of the bristles as viewed from the side is greater at their base (point of attachment to ferrule) than at the bristle tips. FIG. 9 is a top view of brush head 101, showing edges 701, 801 and ferrule 117.

Such a chiseled edge, especially in combination with various configurations of the first and set bristle sets according to aspects of the present principles facilitate simultaneous multi-material blending, and advantageously enables the creation of unique and complex effects during application of, e.g., any solid, semi-solid, liquid materials with improved ease and precision. A brush head according to one aspect of the present principles allows use of either or both bristle sets separately/simultaneously, with, e.g., different applicator materials being applied concurrently or separately as desired. Separate and clean take-up of different substances via a single brush instrument is enabled. Both broad strokes and clean chiseled edges, e.g., in one or more colors/materials may be produced with a single instrument, and a more natural result with improved detail effectuated, e.g., to better emulate natural textures, shadowing, blending, separation of colors, etc.

The bristles utilized in brush heads according to aspects of the present principles may comprise synthetic fibers (e.g., extruded thermoplastic materials), natural fibers (e.g., boar's hair, mink, or any other animal hair/fur, etc.) or any combination of both. In alternate embodiments, the bristles may be treated to impart antimicrobial characteristics therein; that is, the bristles may comprise, e.g., synthetic bristles treated or impregnated with an antimicrobial agent or compound, such as silver in colloidal form, sulphur, or various chemicals as, e.g., disclosed in U.S. Pat. No. 6,108,847 to Microban Products Company, the disclosure of which is incorporated herein by reference thereto. Exemplary thermoplastics include polypropylene, styrene, polystyrene, polyethylene, ABS, PVC, polycarbonate, polyamide, polyester or polyurethane. Thermoset plastics may also be used.

The diameter, density and/or type of bristles may be varied within each brush head according to an aspect of the present invention. That is, the first and second bristle sets may be comprised of different types/amounts of bristles on the same brush head.

In one example, a thickness of each individual bristle used in the first and second brush sets according to the present invention is preferably in the range of about 0.05 mm to about 0.25 mm. For greater uniformity, bristles having several different diameters ranging, e.g., from about 0.07 mm to about 0.15 mm may be provided. A number of bristles in each/both bristle set of the brush head is preferably provided such that a density of the bristles is in the order of at least about 150 bristles per square millimeter. A blend of bristles of different diameters may be incorporated, either in one or both bristle sets. The disclosed density of the bristles and blend advantageously enhances additional control and superior application of an applied product (e.g., cosmetic substances, etc.) as well as enhancing antimicrobial effect when using, e.g., antimicrobial bristles. It is to be noted that a ferrule according to the present invention may comprise any diameter/size in accordance with varying brush head sizes. Depending on the size of the ferrule, more or less bristles may be provided to preferably at least meet the above-disclosed minimum bristle density.

Although the embodiment which incorporates the teachings of the present invention has been shown and described in detail herein, those skilled in the art can readily devise many other varied embodiments that still incorporate these teachings. Having described preferred embodiments for an improved brush (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A brush head having a width X and a central axis, the brush head comprising:

a ferrule having two sides;

a first set of bristles having proximal base ends attached to the ferrule and distal ends defining a first edge situated in a substantially straight first plane perpendicular to the central axis, the first set of bristles having a first width Y, wherein Y<X; and a second set of bristles having proximal base ends attached to the ferrule and distal ends defining a second edge situated in a second plane having a second width (X-Y), wherein a length of each bristle in the first and second sets comprises a distance between its proximal attachment point and its distal end, with the length of each bristle of the second set being at least 50 percent greater than the length of each bristle of the first set to enable either set of bristles to separately take-up different substances;

wherein said first and second set of bristles are arranged in a substantially flattened formation with the base ends of the first set at one side of the ferrule and the base ends of the second set at the other side of the ferrule.

2. The brush head of claim 1, wherein the second plane is substantially perpendicular to the central axis.

3. The brush head of claim 1, wherein the second plane comprises a substantially sloped plane intersecting the central axis at a non-orthogonal angle.

4. The brush head of claim 3, wherein a lower end of the sloped second edge is positioned adjacent to the first set of bristles.

5. The brush head of claim 1, wherein Y=at least 0.35(X).

6. The brush head of claim 1, wherein the first edge and the second edge comprise chiselled edges.

7. A brush consisting of:

an elongate handle extending along a central axis;

a ferrule having two sides attached to the handle at a first end; and a brush head having a width X, the brush head consisting of:

a first set of bristles having proximal base ends attached to a second end of the ferrule and distal ends defining a first edge situated in a substantially straight first plane perpendicular to the central axis, the first set of bristles having a first width Y, wherein Y<X; and a second set of bristles having proximal base ends attached to the second end of the ferrule and distal ends defining a second edge situated in a second plane having a second width (X-Y), wherein a length of each bristle in the first and second sets comprises a distance between its proximal attachment point and its distal end, with the length of each bristle of the second set being at least 50 percent greater than the length of each bristle of the first set to enable either set of bristles to separately take-up different substances.

8. The brush of claim 7, wherein the second plane is substantially perpendicular to the central axis.

9. The brush of claim 7, wherein the second plane comprises a substantially sloped plane intersecting the central axis at a non-orthogonal angle.

10. The brush of claim 9, wherein a lower end of the sloped second edge is configured to be adjacent to the first set of bristles.

11. The brush of claim 7, wherein Y=at least 0.35(X).

12. The brush head of claim 7, wherein the first edge and the second edge comprise chiselled edges.

* * * * *